United States Patent [19]

Marti et al.

[11] 4,222,433

[45] Sep. 16, 1980

[54] GUIDE ROLLER FOR CONTINUOUS CASTING INSTALLATIONS

[75] Inventors: Heinrich Marti, Forch; Friedrich Flückiger, Einsiedeln, both of Switzerland

[73] Assignee: Concast AG, Zurich, Switzerland

[21] Appl. No.: 53,792

[22] Filed: Jul. 2, 1979

Related U.S. Application Data

[63] Continuation of Ser. No. 831,688, Sep. 8, 1977, abandoned.

[30] Foreign Application Priority Data

Sep. 24, 1976 [CH] Switzerland ..... 12114/76

[51] Int. Cl.[3] ..... B22D 11/12

[52] U.S. Cl. ..... 164/448; 29/124; 29/125; 29/130

[58] Field of Search ..... 164/442, 448; 29/117, 29/121.6, 121.7, 124, 125, 129, 130; 308/20

[56] References Cited

U.S. PATENT DOCUMENTS

| | | | |
|---|---|---|---|
| 2,256,193 | 9/1941 | Cobb | 29/129 X |
| 4,010,528 | 3/1977 | Boamer | 29/125 |

FOREIGN PATENT DOCUMENTS

| | | | |
|---|---|---|---|
| 2449934 | 4/1976 | Fed. Rep. of Germany | 164/448 |
| 2454902 | 6/1976 | Fed. Rep. of Germany | 164/448 |

*Primary Examiner*—Robert D. Baldwin
*Assistant Examiner*—Gus T. Hampilos
*Attorney, Agent, or Firm*—Werner W. Kleeman

[57] ABSTRACT

A guide roller for continuous casting installations, the guide roller being subdivided into sections, and the individual sections are interconnected with one another in each instance by means of a plug or journal possessing a support bearing. Each such plug engages into a complimentary recess of a neighboring roller section. Between the plug and the shell of the relevant neighboring roller section there is provided a further bearing permitting lengthwise expansion of the roller section.

5 Claims, 2 Drawing Figures

GUIDE ROLLER FOR CONTINUOUS CASTING INSTALLATIONS

CROSS REFERENCE TO RELATED CASE

This is a continuation application of our commonly assigned, copending U.S. application Ser. No. 831,688, filed Sept. 8, 1977 and entitled "GUIDE ROLLER FOR CONTINUOUS CASTING INSTALLATIONS" now abandoned.

BACKGROUND OF THE INVENTION

The present invention relates to the field of continuous casting, and, more specifically, deals with a guide roller for use in a continuous casting installation or plant, the guide roller being of the type which is subdivided into sections, and the individual roller sections in each instance are interconnected with one another by means of a plug or journal possessing a support bearing, such plug engaging into a complimentary recess of a neighboring roller section.

Such rollers are arranged in the roller aprons and/or in the withdrawal and straightening machines for the guiding, supporting, bending and straightening of wide slabs.

There is already known to the art a guide roller which is subdivided into individual roller sections, wherein the individual sections in each case possess a plug which engages into a complimentary recess of a neighboring roller section. The connection between the plug and the recess should be accomplished in a form- or force-locking manner. If, as disclosed, there is used as the connection a threading, then the danger exists that upon reversal of the rotational direction of the roller or roll this connection becomes loose. One such instance where the direction of rotation of the roller is reversed is, for instance, during the introduction of a starting or dummy bar from below. Furthermore, due to the threadable interconnection of the individual roller parts the entire roller assembly is to be considered as a rigid body, and thus, there is an undefined statis mounting thereof. Also guide rollers, whether at the region of the secondary cooling zone or thereafter, are exposed to a pronounced thermal load, and furthermore to irregular thermal stresses over the roller cross-section. Compensation thereof must be accomplished by appropriate construction of the rollers, since otherwise there arise undesired bulging or bowing-out. The heretofore known roller, however, only is equipped with fixed bearings, and, additionally, at the threaded connection there is not possible any relative movement for compensating for the thermal stresses and the expansions caused thereby. When using a keying connection there appear forces which are difficult to control. Especially upon the occurrence of different roller diameters, for instance due to irregular wear of individual, juxtapositioned roller sections, the use of a keying connection prevents relative movement between the individual roller sections, so that forces are transmitted to the sensitive strand skin or shell. This is especially disadvantageous in the first zone of a roller apron, since in consequence thereof the strand shell or skin which still possesses a small wall thickness is intensively loaded and there can occur fissures.

SUMMARY OF THE INVENTION

Hence, with the foregoing in mind it is a primary object of the present invention to provide an improved guide roller for continuous casting installations which is not associated with the aforementioned drawbacks and limitations of the prior art constructions.

Another and more specific object of the present invention aims at the provision of a roller subdivided into individual roller sections, wherein such roller, even in the presence of unequal diameters of the individual roller sections, enables a relative movement of the sections with respect to one another in the direction of rotation during the continuous casting operation.

Yet a further significant object of the present invention aims at a novel construction of roller for a continuous casting installation which is constructed so as to render possible a lengthwise expansion of the roller, in order to thereby avoid impermissible thermal stresses.

Another important object of the present invention is concerned with a new and improved construction of guide roller for continuous casting installations, which guide roller is of the type provided with individual roller sections which are interconnected in such a manner that loosening of the connection between the roller sections does not occur, even in the case of driven rollers, when the roller rotates in both possible rotational directions.

Now in order to implement these and still further objects of the invention, which will become more readily apparent as the description proceeds, the roller construction of the present development is manifested by the features that between the plug and the shell of the relevant neighboring roller section there is provided a further bearing which enables lengthwise expansion of the roller section.

Consequently, the load which emanates from the ferrostatic pressure of the strand bearing upon the roller section, is transmitted to the plug protruding out of the support bearing. Hence, there occurs a bending-through compensation, since there are introduced from the protruding plug forces into the neighboring roller cross-section, whereby, again, there is realized a favorable total bending line. In the presence of different roller section-diameters there does not occur any force transmission to the strand skin, since in the bearing there is possible a relative movement of both sections to one another in the direction of rotation. Undesired thermal stresses are avoided due to the provided for possibility of an unhindered lengthwise or longitudinal expansion. Since the plug end is not fixedly clamped, there is also reduced the danger of fatigue rupture. The entire roller body is statically defined. The rotatability of the roller in the two directions is ensured for without any fear of loosening the connections of the roller sections. Additionally, the roller requires for each bearing, instead of two bearing housings, in each case only one housing, thereby affording more space for the bearing arrangements, seals and cooling. The unsupported part of the slab between the sections is smaller, resulting in smaller bulging-out and thus improved strand quality. Furthermore, there is also simpler the water transition in relation to rollers possessing independent bearings. Also there can be employed identical, exchangeable rotational bodies, so that there is increased the economies of the system.

There is advantageously employed as a bearing a spherical bearing, for instance, possessing a ball socket, thereby preventing any canting in the bearing upon slight bending-through of the roller.

It is advantageous to subdivide the roller into three roller sections. In this way there is realized a low structural height, simpler design of the housing as well as a more favorable bending line i.e., deflection curve bending line.

BRIEF DESCRIPTION OF THE DRAWINGS

The invention will be better understood and objects other than those set forth above, will become apparent when consideration is given to the following detailed description thereof. Such description makes reference to the annexed drawings wherein there is shown in the various Figures, by way of example, an embodiment of a non-driven roller constructed according to the invention and wherein.

DETAILED DESCRIPTION OF THE PREFERRED EMBODIMENTS

Figure 1:
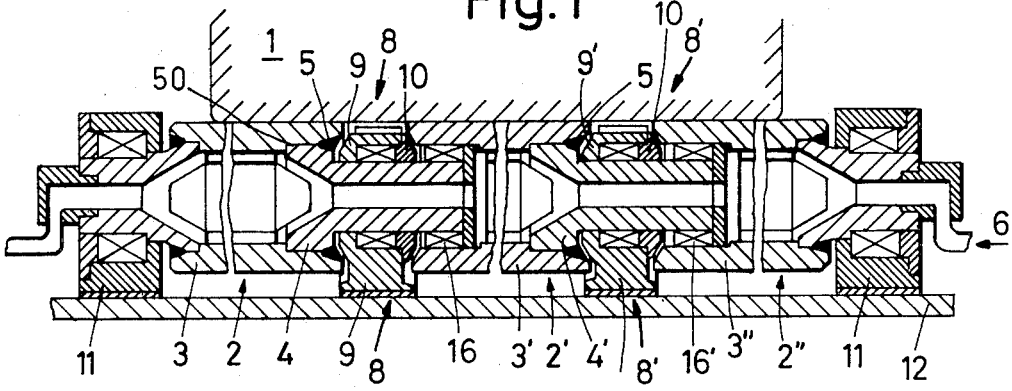
FIG. 1 illustrates a longitudinal sectional view through a roller constructed according to the invention and a sectional view through a continuously cast strand which is guided by such roller.

Describing now the drawings, according to the showing of FIG. 1 a continuously cast strand 1, for instance formed of steel, is guided by a roller or roll. This roller will be seen to comprise individual roll or roller sections 2, 2', 2'', each of which possess a respective roller jacket or shell 3, 3', 3'' and associated roller plugs 4, 4' or equivalent structure. The individual roller sections 2, 2', 2'' are connected in each case with one another by means of the plugs, 4, 4'. The relevant plug 4, 4' engages into the complimentary recess 50 of the neighboring roller section. Each roller shell 3 and plug 4 are interconnected by a welding seam 5 or other appropriate connecting means. The roller, as indicated generally by the arrow 6, is water-cooled. Seated upon the plugs 4, 4' are the water-cooled support bearings 8, 8' together with their housings 9, 9' and cover members or covers 10, 10' respectively, and such support bearings as well as also the end bearings 11 of the roller are attached to a traverse or crosswise extending member 12 or the like. The forces transmitted by the slab 1 to the roller are conducted by means of these bearings 8, 8', 11 to a not particularly illustrated, but conventional roller apron framework. Between the plugs 4, 4' and the roller shell 3', 3'' of neighboring roller sections 2' and 2'', respectively, there are located the further bearings or bearing means 16 and 16'. These take-up the changes in length of the roller sections which are caused by the hot slab 1 and during bending-through of the roller also transmit the forces which are introduced by means of the protruding plugs, so that there is realized an improvement in the deflection curve bending line. If during use of the roller which lasts over a longer period of time there result different roller diameters of the roller sections, then by virtue of the relative movements between two neighboring roller sections which are possible by virtue of the provision of the bearings 16, 16', no damaging forces are transmitted to the strand or its skin or shell.

Figure 2:
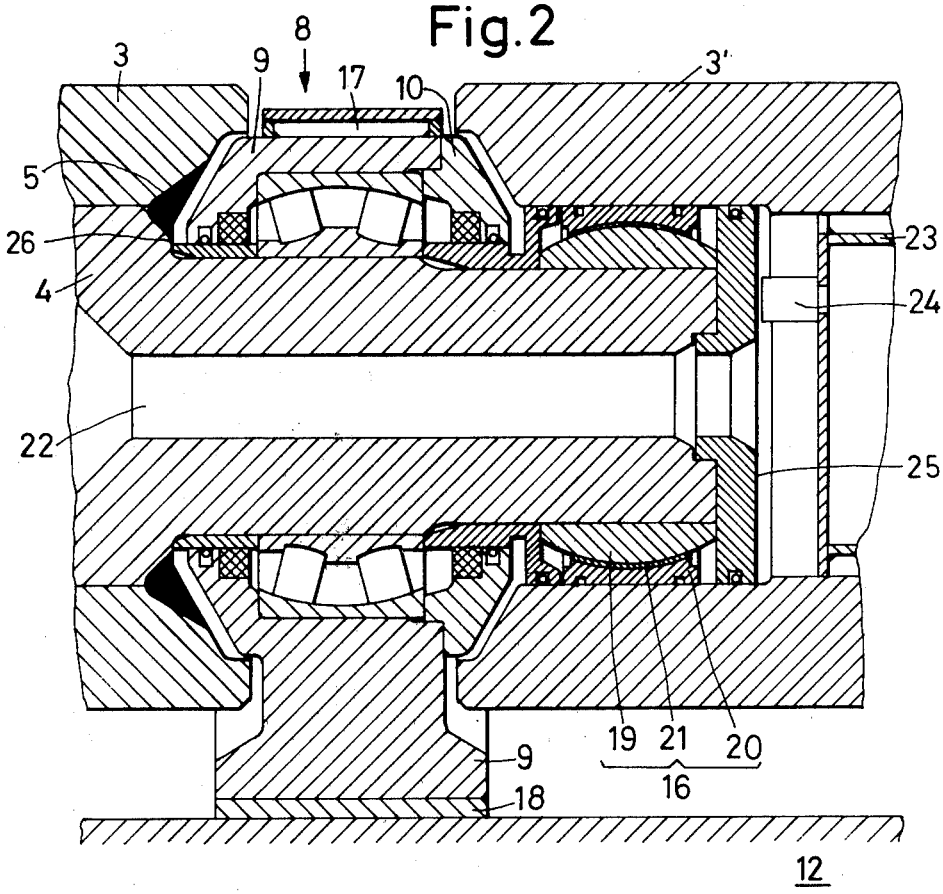
FIG. 2 is a longitudinal sectional view, on an enlarged scale in relation to the showing of FIG. 1, through the plug of the one roller section equipped with a support bearing and through the bearing in conjunction with the neighboring roller section.

FIG. 2 shows further details of the connection between two roller sections as well as the mounting or bearing arrangement thereof. The support bearing 8 is cooled by water which flows in a channel 17. Between the bearing housing 9 and the traverse 12 there is located a spacer plate 18 for the exact adjustment of the bearing height. The bearing 16 seated upon the plug 4 is a maintenance-free, spherical bearing and essentially consists of an inner ring 19, an outer ring 20 and an intermediately disposed plastic layer 21. The inner ring 19 of the bearing 16 is pressed with the aid of a cover 25 equipped with screws by means of intermediate elements and the inner ring of the support bearing 8 at the collar 26 of the plug 4. The outer ring 20 is slidingly mounted for movement through about 3 millimeters in the roller shell 3', permitting the lengthwise expansion of the roller section 2. The bearing 16 furthermore renders possible taking-up of bending-through of a plug. Instead of the spherical bearing it would be possible to also use a self-aligning roller bearing. The cooling water flowing through the plug bore 22 is guided at the outside past a tubular-shaped sheet metal or plate cylinder 23. Instead of this construction there could also be used a solid roll having cooling bores. At this cylinder there is located an impact or stop bolt 24 which determines its position in the lengthwise direction.

The described exemplary embodiment will be seen to possess three roller or roll sections. If, for instance, in the case of large slab widths there is desired only a slight bending-through, then there is possible a subdivision of the roller into four or more sections.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A guide roller for use in continuous casting installations, said guide roller comprising:

a plurality of interconnected individual guide roller sections; at least one of said guide roller sections having a plug means fixedly connected to one end of said guide roller section for interconnecting two neighboring roller sections with one another; said plug means being provided with a support bearing for supporting said guide roller section and for allowing rotation of said plug means relative to a bearing holder;

at least one guide roller section being shaped at one end thereof to define a complimentary recess receiving an associated plug means of a neighboring guide roller section; each guide roller section having a roller shell; and further bearing means for enabling lengthwise expansion of a related roller section provided between the plug means and the roller shell of the related neighboring roller section and for enabling relative movement of each roller section with respect to each other.

2. The guide roller as defined in claim 1, wherein: each said further bearing means comprises a spherical bearing.

3. The guide roller as defined in claim 1, wherein: said guide roller comprises three roller sections.

4. The guide roller as defined in claim 1, wherein:

said further bearing means enables relative movement of the roller sections with respect to one another in the direction of rotation of said roller sections even in the presence of unequal diameters of said roller sections.

5. The guide roller as defined in claim 1, wherein:

each said further bearing means comprises an inner ring, and outer ring, and an intermediate plastic layer.

* * * * *